US008646466B2

(12) United States Patent
Howard et al.

(10) Patent No.: US 8,646,466 B2
(45) Date of Patent: Feb. 11, 2014

(54) INTERCHANGEABLE HEADBAND COVER

(76) Inventors: Cristy Marie Howard, Austin, TX (US); Sean Michael Howard, Wenatchee, WA (US)

( * ) Notice: Subject to any disclaimer, the term of this patent is extended or adjusted under 35 U.S.C. 154(b) by 98 days.

(21) Appl. No.: 13/068,509

(22) Filed: May 13, 2011

(65) Prior Publication Data

US 2012/0285480 A1 Nov. 15, 2012

(51) Int. Cl.
*A45D 8/12* (2006.01)

(52) U.S. Cl.
USPC ..... 132/275

(58) Field of Classification Search
USPC ..... 132/273, 275, 276–279; 2/171, 174, 2/209.14, 207, 209, 181, 183
See application file for complete search history.

(56) References Cited

U.S. PATENT DOCUMENTS

| | | | | | |
|---|---|---|---|---|---|
| 3,211,160 | A | * | 10/1965 | Miller | 132/275 |
| 4,502,298 | A | * | 3/1985 | Benton | 63/1.14 |
| 5,456,274 | A | | 10/1995 | Selbee et al. | |
| 5,697,387 | A | * | 12/1997 | Hanisco | 132/275 |
| 5,718,001 | A | * | 2/1998 | Wright | 2/209 |
| 5,758,671 | A | | 6/1998 | Thim | |
| 5,829,457 | A | * | 11/1998 | Huang | 132/275 |
| 5,927,296 | A | * | 7/1999 | Maturaporn | 132/273 |
| 5,975,092 | A | * | 11/1999 | Tsai | 132/275 |
| 5,987,647 | A | * | 11/1999 | Ouellette | 2/171 |
| 6,000,408 | A | * | 12/1999 | Maturaporn | 132/273 |
| 6,227,011 | B1 | * | 5/2001 | Cortinovis | 66/171 |
| 6,237,610 | B1 | | 5/2001 | Trevisan | |
| 6,237,611 | B1 | * | 5/2001 | LeCrone et al. | 132/275 |
| 6,332,223 | B1 | * | 12/2001 | Le Gette et al. | 2/209 |
| 6,435,194 | B1 | * | 8/2002 | Babay | 132/275 |
| 6,564,390 | B2 | * | 5/2003 | Vernon | 2/171 |
| 6,688,316 | B1 | * | 2/2004 | Klug | 132/286 |
| 7,024,013 | B1 | | 4/2006 | Van Dam et al. | |
| 2006/0027245 | A1 | * | 2/2006 | Spector | 132/273 |
| 2010/0095977 | A1 | | 4/2010 | Schmitz et al. | |

FOREIGN PATENT DOCUMENTS

| | | | |
|---|---|---|---|
| CA | 2052355 | A * | 3/1993 |

* cited by examiner

*Primary Examiner* — Robyn Doan
(74) *Attorney, Agent, or Firm* — GFD Patents LLC; Gerald F. Dudding

(57) ABSTRACT

The Interchangeable Headband Cover is an easily applied and removed material covering that sit on a C Shaped or Horse Shoe Shaped headband. A C Shaped or Horse Shoes Shaped headband typically is used to pull a wearers hair out of their eyes. The exposed area of the design is undecorated. The unexposed outer area of The Interchangeable Headband Cover has two insertion points with overlapping flaps positioned laterally of a fused center. The flaps open wide and enable the user to easily manipulate and apply the covering to a headband without any special tools. As you exam the insertion point closest to the internally fused center the design does not overlap but as you look laterally there is a gradual increase where the materials overlap more and more until there is one portion of the fabric completely covers the other at the internally fused tips.

4 Claims, 5 Drawing Sheets

INTERCHANGEABLE HEADBAND COVER

1. FIELD OF THE INVENTION

The present invention relates generally to headwear. More specifically, the present invention relates to covered headbands.

2. BACKGROUND

Most of us are familiar with headbands. They are most associated as a device that a woman or man uses to pull back hair or use as a fashion accessory. These particular types of headbands come in different styles and shapes. A headband can be as simple as a cloth that is wrapped around the head and tied or it is a molded device that may or may not be covered in cloth. Our invention, The Interchangeable Headband Cover, was designed to fit over a molded C Shaped Headband also known as a Horseshoe Shaped Headband.

A C Shaped Headband can be purchased in the store covered with or without cloth. The headbands that have no cloth covering are typically hard plastic. Most headbands that are covered in cloth are done so in such a way that it is permanently attached with an adhesive and is not meant to be removed. The fact that the materials are permanently attached limits the ability of a user to color coordinate and decreases the life expectancy of the headband. The life expectancy of the headband is limited because the materials become worn. The user of the headband then has the option to discard or keeping using a worn headband.

The Interchangeable Headband Cover offers a solution that allows a user to easily apply and remove a cover to a clothed or unclothed C shaped Headband. This will extend the life of a headband and it will allow a user to have more color options. The Interchangeable Headband Cover is also washable preventing a headband in good condition from being discarded.

After reviewing other patents I have seen different features that make their designs unique. In U.S. Pat. No. 6,237,611 the band has a cavity on the exterior surface. This cavity holds a device that allows accessories to be attached and removed from a headband. In U.S. Pat. No. 5,456,274 the invention includes a headband and a removable covering. The design of the cover in FIG. 1 of U.S. Pat. No. 5,456,274 show that cover is applied, removed and seated by a vastly different method than the Interchangeable Headband Cover. It also has a special headband that is used specifically with this cover. The Interchangeable Headband Cover takes an existing band and allows a user to cover it with ease. There are also no complicated parts that are required so that band is securely attached. It stays seated because the tips serve as tension points allowing the cover to conform to the headband securely.

If you review designs for headband covers made specifically for a C shaped head band you will find that it is a cloth that slips on to a headband that is uniform and length and width. The opening or insertion point is slightly above the tip and on the underside of the cover. Also the covers may have insertion points at the tips. A tip insertion point is demonstrated in U.S. Pat. No. 5,987,647.

This is a practical design and it serves the purpose well. However, its design does not solve the problem for headbands that have a greater width at the center than at the tips. It also does not allow the user easily grasp the opposing end and slide the headband in with ease. The Interchangeable Headband Cover was designed with comfort, ease of use, a greater width at the center and overall life span of the cover and the headband in mind.

The Interchangeable Headband Cover will give a classic C Shaped or Horseshoe Shaped headband diversity and be a benefit to a the Interchangeable Headband Cover can be sold with the plastic C shaped headband with various colors of the Interchangeable Headband Cover included. Alternatively the cloth covering can be sold separately from a headband. The options that consumers have increase as a result of the Interchangeable Headband Cover coming to the market place.

Types of C shaped bands and the modifications or coverings can be found in the following patent publications:

U.S. Pat. No. 0,027,245
U.S. Pat. No. 6,237,611
U.S. Pat. No. 6,513,167
U.S. Pat. No. 5,987,647
U.S. Pat. No. 0,202,548
U.S. Pat. No. 5,456,274
U.S. Pat. No. 5,987,647

SUMMARY OF THE INVENTION

The Interchangeable Headband Cover is a tool used to cover, protect and provide aesthetic beauty to a headband. The types of headband that are used with this cover are greater in width at the center of the band (which sits on the top of the head) than at the tips. There are no tools and a consumer can use the Interchangeable Headband Cover and apply to headbands that that are not decorated by protruding objects and may or may not have an existing cloth covering.

A first aspect of the present invention provides a headband cover. Two insertion points exist on the underside of the cover. The two insertion points gradually and uniformly overlap until completely overlapping at the tips, which serve as tension points. An internally fused center channel that runs 1.5 to 3 inches in opposing directions. The total length of the center channel is 3 to 6 inches. Two tips that serve as tension points exist laterally from the center channel and are fused together on the interior of the materials. The two tips have four layers of material and are positioned on the underside headband and at the pressure points behind the ears. The headband cover has four sloped edges. The sloped edges begin at the midpoint and touch the edges of the headband the cover is applied to. They occur at the top and bottom of the fabric and are uniform on the opposing side. The slopes cease to exist at the tips where the edge is vertical and the slope is undefined. The slopes are soft with no rough edges or protrusions.

BRIEF DESCRIPTION OF FIGURES

The features of the invention are set forth in the appended claims. The invention itself, however, will be best understood by reference to the following detailed description of an illustrative embodiment when read in conjunction with the accompanying drawings, wherein:

DETAILED DESCRIPTION OF THE INVENTION

The Interchangeable Headband Cover 9 is a tool used to cover, protect and provide aesthetic beauty to a headband 10. The types of headband that are used with this cover 9 are greater in width at the center of the band (which sits on the top of the head) than at the tips. There are no tools and a consumer can use the Interchangeable Headband Cover 9 and apply to headbands 10 that that are not decorated by protruding objects and may or may not have an existing cloth covering.

The invention is a material covering designed to be applied to a C shaped headband 10 that may vary in width around its circumference. The covering is easily applied, removed and reapplied to a C shaped headband 10 without the use of any additional tools. The covering is designed to be interchangeable so that the wearer may use the cover to make their headband 10 more comfortable and attractive.

After the user dresses the existing band the outer fabric lays flat and conforms to the shape of the band. The inner, unexposed area of the Interchangeable Headband Cover also conforms to the band with one insertion point flap overlapping the other. The insertion point has minimal visibility once the cover is applied to the headband and it is seated correctly. The aesthetic nature of the minimally visible insertion point is not of great concern for visual reasons but it does play a role in the comfort and conforming nature of the band. The two tension points at either end of the Interchangeable Headband Cover 9 have a non-visible seam that is in the interior of the band. This hidden seam and overlapping flap design allows the end points of the headband 10 that pinch and cause discomfort behind the ear to be more padded. The headband can fit snuggly without causing unnecessary, painful pressure.

The user inserts the band into the insertion point under one of the flaps located on either side of the center channel. The band is then rotated until centered inside of the Interchangeable Headband Cover's 9 center channel 4. As the band is rotated and centered it may protrude from the opposing insertion point. After the band is centered in the Interchangeable Headband Cover 9 the tips of the Interchangeable Headband Cover 9 are seated on the tips of the C Shaped headband by opening the insertion point flaps located on right and left sides of the center channel. This allows the user to be able to grasp and manipulate the band until the band is properly covered. It also allows the user to place the end points of Interchangeable Headband Cover 9 over the tips of the C shaped band. The center channel and the end points of the Interchangeable Headband Cover 9 allows for proper seating and tension. These specific traits of the Interchangeable Headband Cover design allow the fabric to conform to the band on both the visible and non-visible side of the band.

Figure 1:
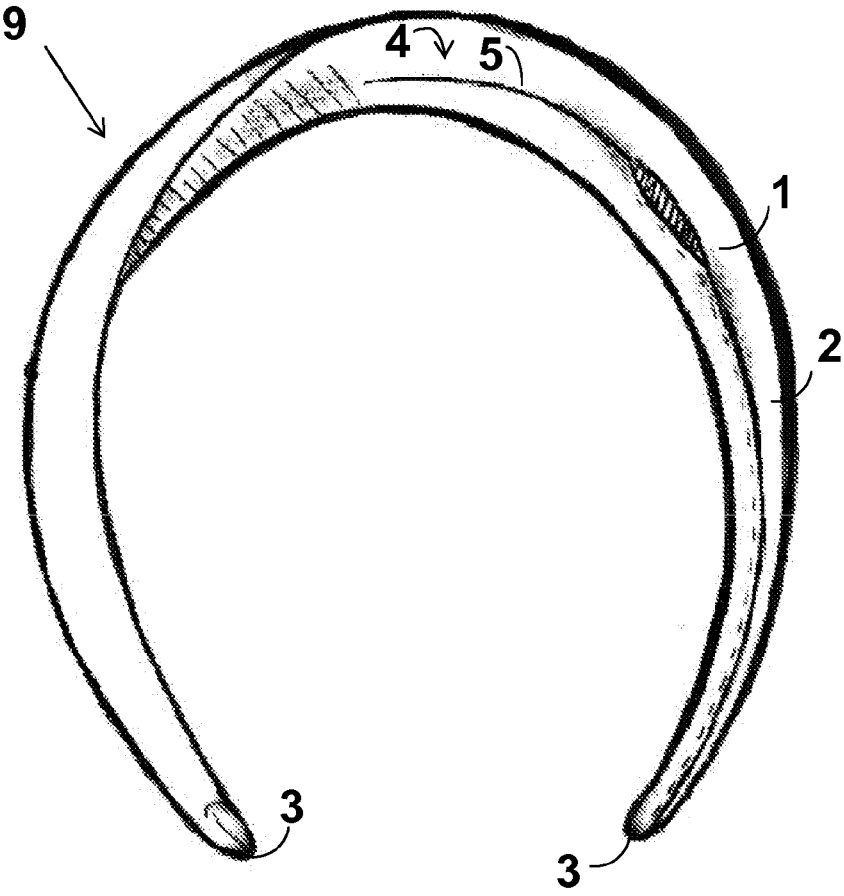
FIG. 1 depicts a front elevation view of a headband, in accordance with embodiments of the present invention.

FIG. 1 is right angled view of the Interchangeable Headband Cover 9 when attached to a C shaped headband 10. 1 details an insertion point for a C shaped headband 10 that is located on the side of the image labeled 5. 5 of the Interchangeable Headband Cover 9 is the unexposed exterior layer when the headband is worn for normal use. 5 is the most decorated portion of the Interchangeable Headband Cover 9. 5 also houses the unique fused center of the Interchangeable Headband Cover 9 which variable but typically spans in length from 1.5 to 3 inches from the mid-point of the length of the design in both directions. The width of the center channel is variable. This fused center channel is displayed in 4. Another unique feature which provides comfort and conformity of the design to the headband is the overlapping flap which is located on both the right and left side of the length of design starting at 1.5 to 3 inches from the mid-point. The overlapping flap of the Interchangeable Headband Cover 9 is displayed in 2. The dashed lines appearing by the overlapping flap in 2 of the interchangeable Headband Cover 9 are only to emphasize the seamed edges and to illustrate this section of the image is overlapping and not bound at the center.

3 of the Interchangeable Headband is fused tension point where the overlapping flaps meet snug and mount on the tips of the Headband 10. The overlapping design allows not only allows for tension and mounting but also adds additional padding and may provide additional comfort to the wearer. 6 is a partial view of the exposed exterior portion of the Interchangeable Headband Design.

Figure 2:
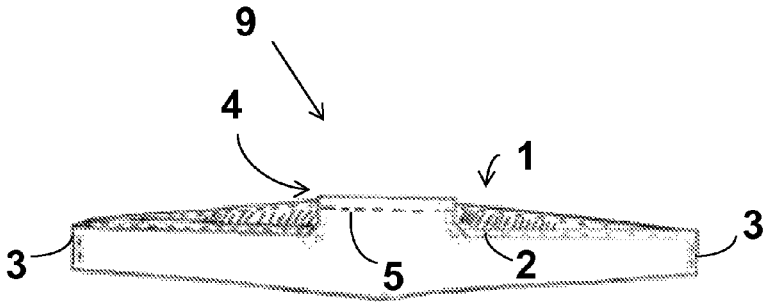
FIG. 2 depicts a front elevation view of a headband enclosed in an Interchangeable Headband Cover, in accordance with embodiments of the present invention.

FIG. 2 is an Interior side view of the Interchangeable Headband Cover 9 when semi-flat. 1 is the insertion point where a C shaped headband 10 passes through which is detailed by the striations that are slightly diagonal. The headband insertion point typically starts at 1.5 to 3 inches from the mid-point of the length of the Interchangeable Headband Cover 9. 2 is the overlapping flap which opens up to expose the headband insertion point when lying on its side. The dashed lines are only to emphasize that the materials are seamed but not fused at the center leaving an opening. 4 is the center channel that variable in length but typically spans between 1.5 to 3 inches from the midpoint. The dashed lines are to indicate that center channel is fused to the material on the unseen portion of the image. 7 is to indicate that is a side view of the interior as the design lays semi-flat.

Figure 3:
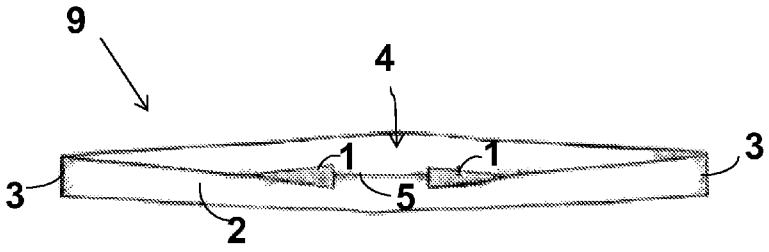
FIG. 3 depicts a side elevation view of the Interchangeable Headband Cover prior to operably coupling the lateral edges along a length of the elongated body of the central portion, in accordance with embodiments of the present invention.

FIG. 3 is a flattened exterior view of the unexposed/functional side of the Interchangeable Headband Cover 9. The exterior exposed view is undecorated. 1 is the insertion point which is located on both right and left lateral sides of the center channel of the design of the Interchangeable Headband Cover 9. 2 is the overlapping flap. This flap can be pulled open to further expose the insertion point. The overlapping flap begins at the end of the center channel and is fused together on the interior of the end tension point which is located at 3. 4 is the fused center channel which extends laterally in both right and left directions and is variable in length but typically ranges between 3 to 6 inches in length. The width of the center channel, going in the directions of top to bottom, is also variable and is dependent of the width of the C shaped or Horseshoe shaped headband. 5 is to call attention to the fact that we are looking at the exterior unexposed portion of the Interchangeable Headband Cover 9.

Figure 4:
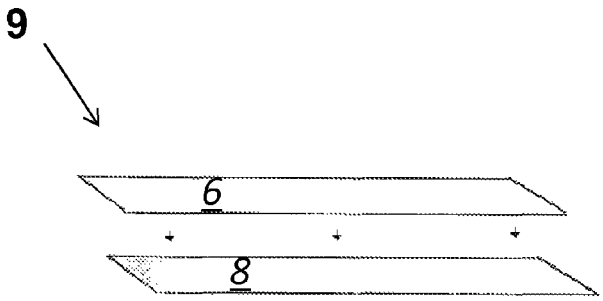
FIG. 4 depicts a side elevation view of the Interchangeable Headband Cover after operably coupling the lateral edges along a length of the elongated body of the central portion, in accordance with embodiments of the present invention.

FIG. 4 shows that two layers are involved in the making of the Interchangeable Headband Cover 9. 6 is the outer exposed material. The directional arrows pointing downward are to illustrate that this layer of fabric is mounted on top and fused to the bottom layer 8. The fusing of the two materials gives design stability and durability.

Figure 5:
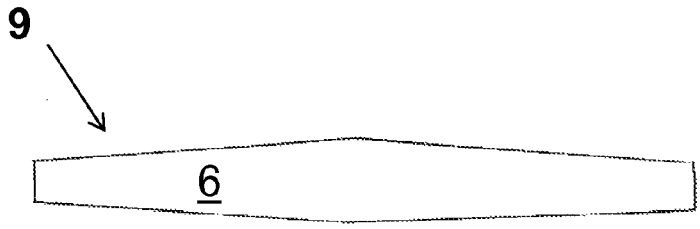
FIG. 5 depicts a front elevation view of a rectangular piece of fabric, divided into two pieces prior to operable coupling, in accordance with embodiments of the present invention.

FIG. 5 is an exterior exposed view of the Interchangeable Headband Cover 9 flat and unattached to a C Shaped or Horseshoe Shaped Headband. It is un-ornamented and has been provided to the reader for a better unobstructed view of the un-mounted design of the Interchangeable Headband Cover 9.

Construction of the Interchangeable Headband Cover

Two pieces of pliable material one which is a light to medium weight stabilizer are cut into a rectangle with an area of approximately 14.5"×3.5" with a deviation of 0.5" in length or width.

The most outer piece of fabric is laid flat with the right side facing down and the stabilizing material is the then attached to the wrong side. Some stabilizing materials are heat fused others fused during the sewing process. The fabrics may be fused using a surged stitch around the ends.

After the materials are fused the width of the material is folded in half. The right side of the material should be totally enclosed with only the wrong side of the stabilizer showing.

At the midpoint of the material a measurement of 1.5" to 3" should made and marked.

This measured area with a total of 3" to 6" is fused with a straight stitch with ¼" to ½" seam. The first and end portions of the stitch should be back stitched to keep the seamed area from coming undone.

After this step 5 you will notice that there are four edges of fabric lateral from the fused center. Take a ¼ of fabric and fold it over. The two stabilizing materials should touch and ¼" of the right side of the outer fabric should be exposed. The fabric is then straight stitched together.

After step 6 is complete and all four edges have been stitched to specification you can complete the cover. This is done by taking the edges of the material, overlapping the ends and fusing them together. The stabilizing material should still be exposed. The only portion of the outer right side of the fabric you should see is the ¼" seamed straight stitch. At the lateral end of each side take one side of the fabric and tuck under the other. Take the other piece of material and lay it on top of the tucked portion. You will have 6 layers of fabric at the ends that are approximately the same measurement. So if the width is 3.5" each layer with be approximately 1.16". You can check this by rotating material and looking at the end. You should also make sure that the outer most overlapping portion of the end is the same on both lateral sides. After verify that the material is folded uniformly and the each layer upon visual inspection is looks approximately the same the ends are straight stitched with approximately a ¼" to ½".

The material is then turned with the right side facing out and the process of making the Interchangeable Headband Cover is complete.

We claim:

1. A headwear assembly, comprising:

a headband; and a headband cover, the headband cover comprising:

a closed center channel, open at each end;

two elongated and uniform insertion points, one on each side lateral to the center channel;

overlapping flaps comprising:

four sloped edges, wherein the sloped edges begin at a midpoint of the headband cover and touch the edges of the headband the cover is applied to, and wherein the sloped edges occur at the top and bottom of the fabric and are uniform on opposing faces of the fabric and two distal fused tips, wherein the overlapping flaps are located on both the right and left side of a length of the headband cover and extend from the a mid-point of the center channel and gradually and uniformly overlap the insertion points until completely overlapping the insertion points at the tips which serve as tension points of the cover when the headband has been removably inserted into each of the elongated and uniform insertion points.

2. The headband cover of claim 1, wherein the closed center channel is an internally fused center channel and runs 1.5 to 3 inches along a longitudinal axis of the headband cover and the total length of the center channel is 3 to 6 inches.

3. The headband cover of claim 1, wherein the two tips that serve as tension points exist laterally from the center channel and are fused together on the interior of the materials.

4. The headband cover of claim 1, wherein two tips have four layers of material that are positioned on the underside of the headband and at pressure points behind a user's ears.

* * * * *